United States Patent [19]

Binder et al.

[11] Patent Number: 4,878,784

[45] Date of Patent: Nov. 7, 1989

[54] FEED CHUTE ARRANGEMENT FOR TEXTILE MACHINES, SUCH AS CARDING MACHINES

[75] Inventors: Rolf Binder, Schottikon; Paul Staeheli, Wilen b. Wil; Urs Staehli, Turbenthal; Fritz Knabenhans, Winterthur, all of Switzerland

[73] Assignee: Rieter Machine Works Ltd., Winterthur, Switzerland

[21] Appl. No.: 138,835

[22] Filed: Dec. 28, 1987

Related U.S. Application Data

[63] Continuation of Ser. No. 770,643, Aug. 28, 1985, abandoned.

[30] Foreign Application Priority Data

Sep. 18, 1984 [CH] Switzerland ..... 04465/84

[51] Int. Cl.[4] ..... B65G 53/48; B65G 53/66; B65G 53/60

[52] U.S. Cl. ..... 406/70; 406/12; 406/19; 406/23; 406/171; 19/105

[58] Field of Search ..... 406/70, 12, 19, 23, 406/155, 156, 171; 19/105

[56] References Cited

U.S. PATENT DOCUMENTS

| | | | |
|---|---|---|---|
| Re. 27,967 | 4/1974 | Binder et al. | 406/19 |
| 2,708,603 | 5/1955 | Yost | 406/23 |
| 2,940,795 | 6/1960 | Peters | 406/23 |
| 3,112,139 | 11/1963 | Wildbolz et al. | 406/120 X |
| 3,851,924 | 12/1974 | Roberson et al. | 406/156 X |
| 3,863,990 | 2/1975 | Ballard, Jr. | 406/156 |
| 4,030,635 | 6/1977 | Hablutzel et al. | 406/19 X |
| 4,154,485 | 5/1979 | Lytton et al. | 406/156 X |
| 4,240,180 | 12/1980 | Wood et al. | 19/105 |
| 4,379,663 | 4/1983 | Allison | 406/23 |
| 4,394,790 | 7/1983 | Keller et al. | 406/171 X |
| 4,403,374 | 9/1983 | Wood | 406/171 X |
| 4,476,611 | 10/1984 | Keller et al. | 406/171 X |
| 4,701,981 | 10/1987 | Leifeld | 406/156 X |

FOREIGN PATENT DOCUMENTS

| | | | |
|---|---|---|---|
| 729040 | 12/1942 | Fed. Rep. of Germany . | |
| 1510323 | 2/1970 | Fed. Rep. of Germany . | |
| 3239524 | 7/1983 | Fed. Rep. of Germany . | |
| 1435978 | 3/1966 | France . | |
| 2509757 | 1/1983 | France . | |
| 501576 | 2/1939 | United Kingdom | 406/70 |
| 953472 | 3/1964 | United Kingdom . | |
| 2043128 | 10/1980 | United Kingdom . | |
| 2099869 | 12/1982 | United Kingdom . | |

*Primary Examiner*—Joseph F. Peters, Jr.
*Assistant Examiner*—James M. Kannofsky
*Attorney, Agent, or Firm*—Werner W. Kleeman

[57] ABSTRACT

A feed chute arrangement for textile machines, such as carding machines includes a feed chute having a plurality of walls one of which is gas-permeable to let gaseous medium to escape from the interior of the feed chute into a neighboring gas output chamber that is bounded by a plurality of additional walls different from the gas permeable wall. One of these additional walls is provided with an opening at which there is pivotally mounted a plate-shaped blocking flap selectively movable between its closed position and a plurality of open positions in which it offers various amounts of resistance to the flow of the gaseous medium from the gas output chamber through the opening into a connecting conduit and eventually into a discharge passage. Fiber material entrained in the gaseous medium and travelling therewith in a transporting duct enters the interior of the feed chute through an open upper end and deposits in the form of a fiber body at the lower end of the interior of the feed chute to be fed therefrom by a pair of feeding rollers. The gaseous transportation medium leaves the interior of the feed chute through the gas-permeable wall and then flows through the gas output chamber and through the opening. An operating device may be employed to move the blocking flap at least toward and into its closed position. A weight may be movably mounted on a bar extending transversely of the blocking flap to select the torque acting on the latter. The operating device may be controlled by the density of the fiber material passing between the feeding rollers.

6 Claims, 2 Drawing Sheets

Fig. 2
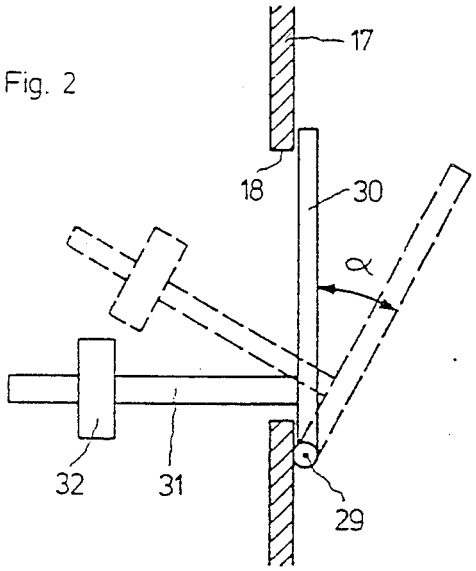
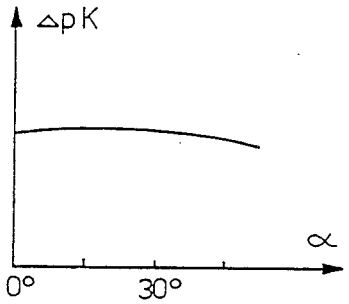
Fig. 3
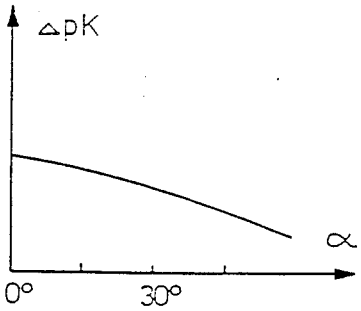
Fig. 4
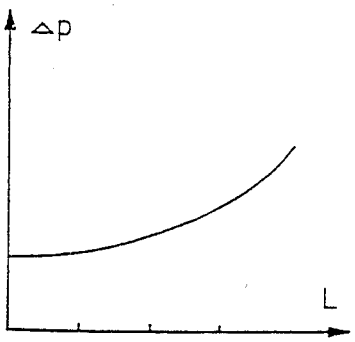
Fig. 5
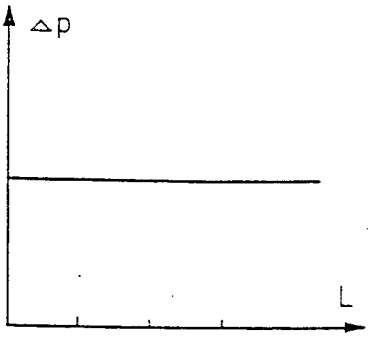
Fig. 6

FEED CHUTE ARRANGEMENT FOR TEXTILE MACHINES, SUCH AS CARDING MACHINES

CROSS-REFERENCE TO RELATED APPLICATIONS

This application is a continuation application of our commonly assigned, copending U.S. application Ser. No. 06/770,643, filed Aug. 28, 1985, and entitled "Feed Chute Arrangement For Carding Machines", now abandoned.

BACKGROUND OF THE INVENTION

The present invention relates to feeding arrangements in general and, more particularly, to a feed chute arrangement for use in feeding fiber material to a textile machine, especially but not exclusively to carding machines.

From the German Published Pat. No. 1,510,323, it is known to provide pivotably mounted flaps which are arranged in a louver-like fashion to cover a perforated wall which is located between the interior of a feed chute and a return flow chute or chamber. This expedient is employed in order to obtain successive filling up of the return flow chute.

On the other hand, the German Published patent application No. 3,239,524 discloses a flap used in a device for feeding fibers to a carding machine. The provision of the flap serves for prevention of variation in the underpressure in the air outflow or output chamber which adjoins a perforated wall of a collecting chamber for the fiber material.

Experience with arrangements of the type described above has shown that they leave much to be desired, particularly as far as their operating characteristics are concerned. Thus, for instance, if it is attempted to discontinue or temporarily interrupt the operation of the feeding arrangement, the fiber material continues to be delivered into the interior of the feed chute, resulting in overfilling of such feed chute and undesired compaction of such material, which causes problems during the resumption of the operation of the feeding arrangement. Moreover, even during the normal operation of the feeding arrangement, that is, without interruption, there is a tendency for the accumulated fiber material to vary in density from time to time and from one region of the fiber body to another, primarily since it is impossible in the conventional feeding arrangements to control the amount of the fiber material which enters the interior of the feed or feeding chute. All this, of course, is very disadvantageous since it adversely affects the operation not only of the feeding arrangement itself, but also of the equipment or textile machine to which the feeding arrangement feeds the fiber material.

SUMMARY OF THE INVENTION

Accordingly, it is a general object of the present invention to avoid the aforenoted disadvantages of the prior art.

More particularly, it is another important object of the present invention to provide a feed chute arrangement which does not possess the disadvantages of the conventional constructions of feed chute arrangements.

Still another significant object of the present invention is to construct a fiber material feeding arrangement of the type here under consideration so as to be able to avoid delivery of the fiber material into the interior of the feed chute or duct during the discontinuance of the operation thereof, without having to shut off the entire system in which the feed chute or duct or the like is employed.

It is yet another noteworthy object of the present invention to design a fiber material feeding arrangement of the above type so as to be able to control the density of the accumulated fiber material in the feed chute or duct or the like and to maintain such density within predetermined, relatively narrow limits.

A concomitant object of the present invention is to devise an arrangement of the above type which is relatively simple in construction, inexpensive to manufacture and install, easy to use, and reliable in operation nevertheless.

In pursuance of these objects and others which will become apparent hereafter, one feature of the present invention resides in an arrangement for feeding fiber material, especially but not exclusively to a carding device, such arrangement comprising a feed chute or duct having a plurality of peripheral walls one of which is gas-permeable and together bounding an accumulation space or interior which has an open upper end or end region for receiving the fiber material travelling through a transporting duct with a gaseous transportation medium and a lower end or end region where the fiber material accumulates in the form of a fiber body upon deposition from the transportation medium that leaves the accumulation space through the gas-permeable wall. A feeding roller pair is arranged at the lower end of the accumulation space and operative for feeding the fiber material of the fiber body out of the accumulation space. There are also provided means for bounding a gas output or outflow chamber in juxtaposition with the gas-permeable wall of the feed chute, including a wall different from the gas-permeable wall and having an opening, and a gas discharge conduit means communicates with the opening. Further provided are means for controlling the flow of the transportation medium into and through the accumulation space, the gas output or outflow chamber, and the opening into the gas discharge means, including a blocking flap pivotably mounted at the different wall for movement between a closed position in which it blocks the opening and a plurality of open positions in which it offers selected amounts of resistance to the flow of the transportation medium through the opening.

It may be seen that the blocking flap of the present invention serves an essentially different purpose than the flaps of the known feeding arrangements. It provides for the possibility of regulating the flow of the transportation medium for the fiber material into the feed chute or duct or the like with a corresponding change in the amount of the fiber material delivered into the feed chute, or even of discontinuing the flow of the transportation medium into the feed chute altogether, with attendant discontinuance of the delivery of the fiber material into the feed chute. This latter possibility is particularly useful when the feeding arrangement is used for feeding the accumulated fiber material to a carding device, since it may be necessary to interrupt the operation of such carding device from time to time while other carding devices associated with the same transporting duct continue to operate.

By constructing the feeding arrangement in the manner described above, there is provided the possibility of controlling or regulating the filling of the interior or accumulation space of the feed chute, as the filling level of the feed chute changes, in dependence on the pressure of the transporting medium which acts on the column or fiber body of the fiber material which is present in the interior or accumulation space of the feed chute. In this manner, an evenly dense or uniform fiber stock is obtained at all levels of filling of the interior or accumulation space of the feed chute. Blockage and overfilling of the feed chute and of the transporting duct are avoided. In other words, by resorting to the present invention, the density of the fiber material in the accumulated fiber body thereof can be selectively influenced, and thus made uniform throughout the fiber body and/or in time, by appropriate adjustments of the resistance offered by the blocking flap. While only carding machines for fiber flocks are mentioned, the arrangement of the present invention is equally applicable to other uses, for instance, in conjunction with carding engines or devices for long staple fibers.

It is particularly advantageous when the gas discharge means includes a connecting conduit arranged at the different wall and a discharge passage communicating with the connecting conduit, and when the blocking flap is situated externally of the gas output or outflow chamber and opens into the connecting conduit.

According to another aspect of the present invention, there is provided a controllable operating device acting on the blocking flap and operative for displacing the latter at least toward and into the closed position thereof. In this manner, it is possible to discontinue the delivery of the fiber material into the interior of the feed chute, regardless of the pressure differential between the transportation duct and the discharge passage, or that between the gas output chamber and the connecting conduit.

It is further advantageous when, in accordance with another concept of the present invention, there is further provided means for adjusting the position of the blocking flap relative to the opening in dependence on the quantity of the fiber material of the fiber body or mass of fiber material which passes between the rollers of the feeding roller pair. In this manner, it is possible to adjust the amount of the transportation medium entering the interior of the feed chute or duct, and thus the rate at which additional fiber material is added to the fiber body and, in the final analysis, the density of the fiber material in the fiber body.

An especially advantageous construction of the feeding arrangement is obtained when there is further provided a weight connected to the blocking flap and exerting a gravitational force thereon which results in a torque that urges the blocking flap toward the closed position thereof. In this context, it is particularly advantageous when the blocking flap is substantially plate-shaped and is mounted for pivoting about a substantially horizontal pivot axis to assume the closed position thereof when extending substantially vertically, when there is further provided a bar rigid with the plate-shaped blocking flap and extending transversely thereof, and when the weight is supported on the bar for selective displacement on the same to different distances from the plate-shaped blocking flap. The plate-shaped blocking flap advantageously extends upwardly from the pivot axis, and the bar is arranged in the immediate vicinitiy of the pivot axis and extends substantially normal to the plate-shaped blocking flap towards the gas output or outflow chamber.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 2 is a view similar to that of FIG. 1 but showing only of a portion of the latter and depicting a modification;

FIGS. 3 and 4 are diagrammatic representations of the air resistance or resistance to air flow produced by the blocking flaps of FIGS. 1 and 2, respectively;

FIGS. 5 and 6 are diagrammatic representations of the pressure differences between the transportation or transport duct and the discharge or outflow passage in FIGS. 1 and 2, respectively.

DETAILED DESCRIPTION OF THE PREFERRED EMBODIMENTS

Figure 1:
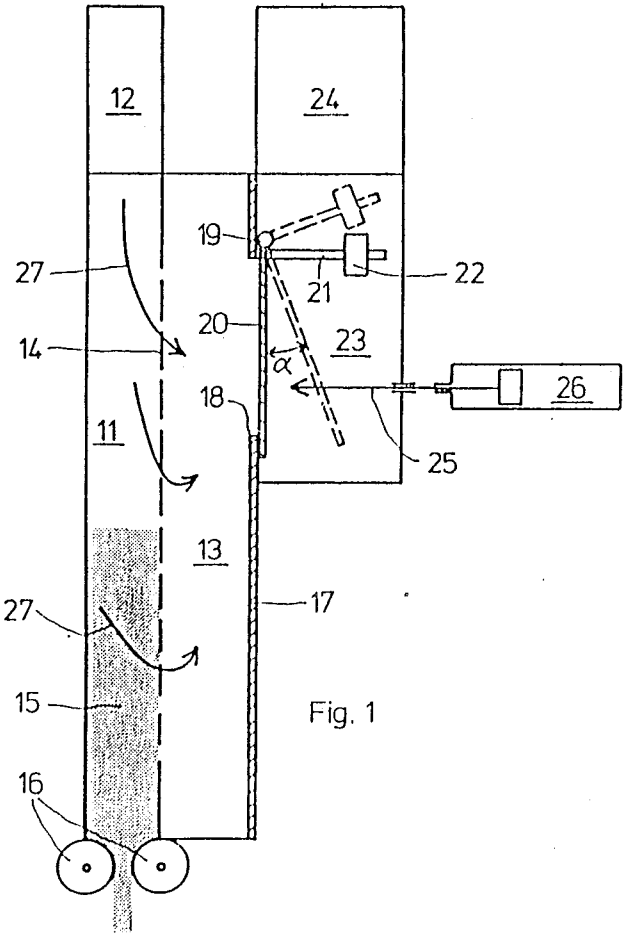
FIG. 1 is a simplified sectioned side elevational view of a fiber material feeding arrangement containing a feed chute arrangement and constructed according to the present invention.

Referring now to the drawings in detail, in which the same reference numerals have been generally assigned to corresponding parts, and first to FIG. 1 thereof, it may be seen that the reference numeral 11 has been used therein to identify a feed chute or duct or the like. The feed chute 11 is supplied with fiber material, as generally indicated by reference numeral 15, which is delivered through the interior of a transporting or transport duct 12. The fiber material 15 is transported in the interior of the transporting duct 12 by means of a suitable transportation or conveying medium, which is typically pressurized air. The feed chute 11 forms an assembly with a gas output or outflow chamber 13, and is separated therefrom by a wall 14 which permits the transportation medium to flow therethrough, for example by being perforated. The fiber material 15 is collected at the lower portion or end region of the feed chute 11 in the interior or accumulation space thereof and is then fed by a feeding roller pair 16 to a carding machine or to an opener roller, neither one of which has been shown since they are each of conventional construction and their details are not necessary for understanding the present invention.

The feed chute 11 and the gas output or outflow chamber 13 are bounded by additional walls, including a wall 17 which is separate from the gas-permeable wall 14 and partially delimits the gas output chamber 13. The wall 17 is provided with an opening 18. Upwardly of this opening 18, and at the external surface of the wall 17 that faces away from the gas outlet chamber 13, there is mounted a blocking member here in the form of a blocking flap 20 which is shown to be constituted by a plate that is mounted for pivoting about an axis defined by a pivot axle or shaft 19. A bar 21 or the like is provided, which extends transversely with respect to the blocking flap 20 and is secured to the latter. The bar 21 supports a weight 22, the spacing of which from the blocking flap 20 is selectively adjustable by displacing the weight 22 on the bar 21. The components 20 to 22 are situated in the interior of a connecting conduit 23 which leads to and communicates with a discharge or outflow passage 24 for the spent transportation or conveying medium. Finally, a controllable pusher member 25 is provided, being operatable by means of an operating device 26 which may be constituted, for example, by a hydraulically or pneumatically operated cylinder-and-piston unit.

Having thus described the construction of the fiber feeding arrangement or feed chute arrangement depicted in FIG. 1 of the drawings, the operation of such arrangement will now be discussed. The fiber material to be delivered into the interior or accumulation space of the feed chute 11 is continuously supplied through the interior of the transporting duct 12 by means of the transportation or conveying medium which flows through the interior of the transporting duct 12 and entrains the fiber material for joint travel therewith. The transportation medium flows in a direction which is normal to the plane of the drawing. When the fibers or fiber flocks travelling with the transportation medium through the interior of the transporting duct 12 reach the open upper end or end region of the feed chute 11, they descend or fall into the interior or accumulation space of the feed chute 11. On the other hand, the transportation medium which has entered the interior of the feed chute 11 flows in the direction indicated by arrows 27. The fiber material 15 which has been deposited at the lower part or portion or end region of the interior or accumulation space of the feed chute 11 is fed by the feeding roller pair 16 to a carding machine or to an opener roller. The air flow indicated by the arrows 27 is in existence only when the blocking flap 20 assumes its at least partially open position, for instance, in the position indicated in dash lines. In this position, the blocking flap 20 is pivoted out of its closed position through an angle $\alpha$. Under these circumstances, the spent transportation medium which has left the interior of the feed chute 11 through the gas-permeable wall 14 into the gas output or outflow chamber 13 passes through the opening 18 past the then open blocking flap 20 and enters the connecting conduit 23 from where it is conducted away through the discharge or outflow passage 24.

In the event that the operation of the feeding roller pair 16 and/or, for instance, the carding device supplied thereby is to be suspended for any reason, then the delivery of the fiber material to the interior, or accumulation space of the affected feed chute 11 should also be stopped. To achieve this, the operating device 26 is energized or activated to move the blocking flap 20 into its closed position. Practically no air can escape from the interior of the feed chute 11 through the gap between the feed rollers of the feeding roller pair 16 and/or between such feed rollers and the walls of the feed chute 11 to begin with. Then, with the increasing quantity of the fiber material 15 in a columnar fiber body of such fiber material which has become accumulated at the lower portion of the interior or accumulation space of the feed chute 11, the ability of the air or similar gaseous transportation medium to pass through the interior of the feed chute 11 is further reduced. Thus, when the blocking flap 20 is in its closed position and a sufficient amount of the fiber material 15 is present in the column-like accumulated fiber body of such fiber material 15 located at the lower portion or end region of the interior of the feed chute 11, practically no air from the transportation duct 12 enters the interior of the feed chute 11. This means that the fiber material which still travels with the transportation medium through the transporting duct 12 is blown across the open upper end or end region of the affected feed chute 11 and no longer enters the interior of the latter. Of course, it will be understood in this context that, as usual in the textile industry, the transporting duct 12 is used to deliver the fiber material to a plurality of feed chutes 11 or the like, so that the delivery of such fiber material to the other feed chutes 11 continues without interruption, despite the closing-off of the affected feed chute 11.

Thus, the illustrated and above-described arrangement renders it possible, in a simple manner, to prevent delivery of additional fiber material, such as fibers or fiber flocks into the interior of the affected feed chute 11 when the associated carding device or other textile machine has been shut off. The fiber material 15 which is already present in the interior of the affected feed chute 11 in the form of the accumulated fiber body thereof is not further compressed by the passage of the transportation medium therethrough under these circumstances. Therefore, over-filling and blockage of the feed chute 11 and/or of the transporting duct 12 are avoided.

The bar 21 and the weight 22 which is secured to the bar 21 in the selected position of the weight 22 along the bar 21 produce, due to gravitation forces, a torque or turning moment on the blocking flap 20. When the cylinder-and piston unit or a similar operating device 26 is not energized or activated to close the blocking flap 20, the blocking flap 20 is opened due to the difference $\Delta p$ in an air pressure between the transportation duct 12 or the gas outlet or outflow chamber 13, on the one hand, and the communicating conduit 23 or the discharge or outflow passage 24, on the other hand. An equilibrium between the pressure-induced and gravitational forces acting on the blocking flap 20 is achieved at a certain inclination of the latter; in this instance, the torque exerted on the blocking flap by the pressure differential $\Delta p$ and that due to gravitational forces are in equilibrium, and the blocking flap 20 remains in this position until the conditions have changed, that is, it is balanced.

The torque exerted by the parts 20, 21 and 22 due to the gravity of such parts 20, 21 and 22 constitutes a compensating resistance moment $\Delta pK$ for the air stream flowing through the interior of the feed chute 11 and through the gas output chamber 13. This compensating resistance moment $\Delta pK$ can be adjusted by repositioning the weight 22 on the bar 21 or by changing the mass of such weight 22. Thus, the compensating resistance moment $\Delta pK$ can be selected as required by the operating conditions and desired conditions of the fiber material 15 in the fiber body. In this manner, the density of the fiber material 15 collected in the interior or accumulation space of the feed chute 11 can be influenced in any desired manner by adjusting the weight 22.

FIG. 2 illustrates a somewhat modified blocking flap construction. The reference numeral 17 again identifies the wall that delimits the gas output or outflow chamber 13, in the same manner as described before in connection with FIG. 1. Obviously, here again, this wall 17 is separate from and not identical with the gas-permeable wall 14 that separates the interior or accumulation space of the feed chute 11 from the gas output or outflow chamber 13. This wall 17 is also provided with the above-mentioned opening 18 which serves for the passage therethrough of the spent transportation or conveying medium from the gas output chamber 13 to a connecting duct 23 and ultimately to the discharge or outflow passage 24, as discussed before with respect to FIG. 1. In the construction depicted in FIG. 2, a blocking flap, here identified by the reference numeral 30, is mounted on the wall 17 for pivoting about a pivot axis defined by a pivot axle or shaft 29. A weight 32 is supported by a bar 31 which is secured to the blocking flap 30 and extends normal to the latter. The weight 32 is selectively adjustable as to its position along the length of the bar 31. Dashed lines once more indicate an open position of the blocking flap 30. When the blocking flap 30 is in its at least partially open position, the transportation medium, typically air, flows from the transporting duct 12, which is not shown in FIG. 2, from left to right as considered in FIG. 2, through the opening 18 to the here non-illustrated discharge or outflow passage 24. The angle through which the blocking flap 30 is pivoted from its closed position is indicated by the reference character $\alpha$.

Turning now to FIGS. 3 and 5 of the drawing, it may be seen that they illustrate certain characteristics of the flow of the transportation medium in the construction of FIG. 1, while FIGS. 4 and 6 illustrate corresponding characteristics of the construction of FIG. 2. In FIGS. 3 and 4, the abscissa is scaled in terms of the pivoting angle $\alpha$ of the respective blocking flap 20 or 30 while the ordinate is scaled in terms of the resistance moment $\Delta pK$ produced by the respective blocking flap 20 or 30. It is evident that the resistance moment $\Delta pK$ remains substantially constant when using the parts 20, 21 and 22 in the arrangement depicted in FIG. 1, but gradually decreases with increasing value of the angle $\alpha$ when using the parts 30, 31 and 32 in the arrangement shown in FIG. 2.

In FIGS. 5 and 6, the quantity of the transporting medium flowing through the opening 18 is identified by the reference character L and is presented on the abscissa, while the ordinate represents the pressure difference $\Delta p$ between the pressure in the transporting duct 12 and the pressure in the discharge or outflow passage 24. The variation in the quantity of the transportation medium L flowing through the opening 18 corresponds to the variation in the angle $\alpha$, so that the abscissa may also be considered to represent the angle $\alpha$. FIGS. 5 and 6 show that in the construction of FIG. 1 the additional pressure produced by the blocking flap 20 increases with the increasing angle $\alpha$, while it remains substantially constant with increasing angle $\alpha$ of the blocking flap 30 in the construction according to FIG. 2. Thus, with increasing angle of opening $\alpha$, the torque or turning moment of the flap 20 results in a reduction in the amount of the transportation medium flowing into and through the interior of the feed chute 11, while the flap 30 tends to hold the quantity of air flowing into and through the interior of the feed chute 11 constant regardless of the angle of opening $\alpha$ of the blocking flap 30.

Thus, according to the present invention, there is provided the possibility to have the resistance offered by the blocking flap 30 independent of the angle of opening $\alpha$ of the blocking flap 30, that is, to hold such resistance constant, or to have an increasing resistance with incresing transportation medium quantity by using the blocking flap 20, as required or desired. By appropriate modification or adjustment of the arrangement of the parts 20, 21 and 22, or 30, 31 and 32, it is also possible to achieve the possibility that the resistance of the blocking flap 20 or 30 decreases with increasing transportation medium quantity. The reducing pressure loss as described above in conjunction with the operation of the blocking flap 30, due to a balanced torque or turning moment, permits, in particular, exertion of a constant pressure on the fiber material in the interior of the chute 11, and thus the achievement of a uniform weight and density distribution in the fiber material body 15 present in the interior of the chute 11.

Figure 7:
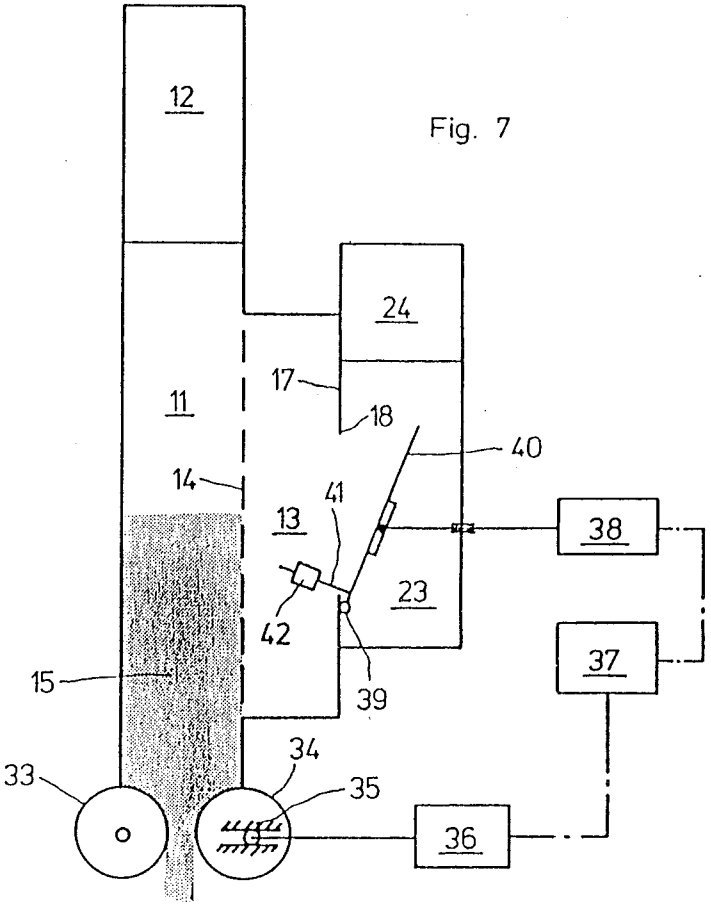
FIG. 7 is a view similar to FIG. 1 but showing a further modification of the feed chute arrangement.

A further modified construction of the arrangement according to the present invention is illustrated in FIG. 7. Like in the construction discussed in connection with FIG. 1, this arrangement also includes a feed chute 11, a transporting duct, a gas output or outflow chamber 13, a perforated wall 14, an opening 18, a connecting conduit 23 and a discharge or outflow passage 24. In this construction, there is provided a blocking flap 40 which is also mounted on the wall 17 that partially delimits the gas output or outflow chamber 13, for pivoting about a pivot axis defined by a pivot axle or shaft 39. Here again, the wall 17 is different from the perforated wall 14. A bar 41 with a weight 42 supported thereon may also be provided in this construction; however, the bar 41 and the weight 42 may be omitted.

Feeding or feed rollers 33 and 34 form a cooperating roller pair. The feeding roller 33 is mounted for rotation about a stationary axis, while the feeding roller 34 is so mounted for sliding in a guide or guide means 35 that the axis of rotation thereof can be moved toward and away from that of the feeding roller 33. The feeding roller 34 is subjected to a bias directed toward the fiber material 15 passing between the feeding rollers 33 and 34, for instance, by means of a non-illustrated spring. The position of the feeding roller 34 in the guide 35 is detected by a signal generator 36 which generates a signal that is indicative of deviation from a predetermined position or value. This signal is dependent on the density, and thus on the thickness, of the fiber material 15 passing between the feeding rollers 33 and 34. This signal is supplied to a regulator 37 which operates, for instance, a drive or operating device 38 by means of which the blocking flap 40 can be pivoted about the pivot axle 39. If it is required to balance out the weight of the blocking flap 40, or the pressure exerted on the blocking flap 40 by the air stream flowing past the same through the opening 18, the aforementioned bar 41 with a weight 42 thereon can be provided to act in the previously discussed manner.

During the operation of the arrangement depicted in FIG. 7, the feeding rollers 33 and 34 feed the fiber material 15 downwardly, while simultaneously compressing such material. If the quantity of the fiber material 15 fed by the feeding rollers 33 and 34 varies, the web of such fiber material 15 passing between the rollers 33 and 34 is not of a uniform thickness. In this case, the feeding roller 34 is caused to move to the right when the thickness of the web increases, and to the left when such thickness decreases. These movements of the feeding roller 34 are transmitted to the signal generator 36 and transformed by the latter into signals, for instance, into electrical signals. These electrical signals control the regulator 37 in such a manner that the regulator 37 produces an output signal which operates the drive 38 in one direction or the other, depending on the circumstances. The operation of the drive 38, in turn, effectuates pivoting of the blocking flap 40 in the opening or closing sense. If the fiber material 15 is too dense, the flap 40 is moved towards its closed position; if the density of the fiber material 15 is insufficient, the blocking flap 40 is opened wider. When the blocking flap 40 is moved in the closing sense, less air flows through the opening 18 and thus also through the interior of the feed chute 11. In this manner, the fiber material 15 is less compressed. Also, because of the lesser air flow into the interior of the feed chute 11 from the transporting duct 12, a greater number of fibers or fiber flocks pass through the transporting duct 12 over the open upper end of the feed chute 11, so that the feed chute 11 is filled less rapidly. This results in a lesser amount of the fiber material 15 in the fiber body, and also in a lower density of such fiber material. On the other hand, if the fiber material 15 is not thick enough, the opposite of the described operations is performed, with the opposite results.

By a suitable choice of, in particular, the characteristic of the operation of the regulator 37, the value of the air resistance exerted by the blocking flap 40 can thus be selected as desired in dependence on the thickness of the fiber material 15 passing between the feeding rollers 33 and 34.

It ought to be mentioned at this juncture that the blocking flaps 20 and 30 must always be outside the gas output or outflow chamber 13, since their pivoting is influenced or caused by the flow of the transportation medium through the opening 18. In the construction illustrated in FIG. 7, a rigid connection is provided between the drive 38 and the blocking flap 40, so that the blocking flap 40 can be located selectively either in the interior of the gas output or outflow chamber 13 or outside such chamber 13 as illustrated.

It will be understood that each of the elements described above, or two or more together, may also find a useful application in other types of arrangements differing from the type described above.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An arrangement for feeding fiber material to a textile machine, especially to a carding device, comprising:

a feed chute having a plurality of peripheral walls one of which is at least partially gas-permeable and together bounding an accumulation space having an open upper end for receiving the fiber material travelling through a transporting duct with a gaseous transportation medium and a lower end;

the fiber material accumulating in the feed chute to a predeterminate filling level in the form of a fiber body upon deposition from the transportation medium that leaves said accumulation space through said gas-permeable wall;

said gas-permeable part of said one peripheral wall, during operation of the feeding arrangement, being covered by said accumulated fiber material to an extent determined by the filling level of said accumulated fiber material;

a feeding roller pair arranged at said lower end of said accumulation space and operative for substantially continuously feeding the fiber material of said fiber body out of said accumulation space, during operation of the feeding arrangement;

means for bounding a gas output chamber in juxtaposition with said gas-permeable wall of said feed chute, including a wall different from said gas-permeable wall and having a gas output opening;

gas discharge means communicating with said gas output opening;

means for controlling the flow of the transportation medium into and through said accumulation space, said gas output chamber, and said gas discharge means, including a blocking flap movably mounted at said different wall for movement between a closed position in which it blocks said gas output opening so that supply of the fiber material into said feed chute is stopped and a plurality of open positions in which it offers selected amounts of resistance to the flow of said transportation medium through said gas output opening to thereby control the density and the filling level of the fiber material accumulated in the form of a fiber body within the feed chute and to maintain such density and such filling level essentially within predeterminate limits; and a weight connected to blocking flap and exerting a gravitational force thereon that results in a torque that urges said blocking flap toward said closed position thereof.

2. The arrangement as defined in claim 1, wherein:

said gas discharge means includes a connecting conduit arranged at said different wall and a discharge passage communicating with said connecting conduit; and said blocking flap being situated externally of said gas output chamber and opening into said connecting conduit.

3. The arrangement as defined in claim 1, further including:

a controllable operating device acting on said blocking flap and operative for displacing the latter at least toward and into said closed position thereof.

4. The arrangement as defined in claim 1, wherein:

said blocking flap is substantially plate-shaped;

means mounting said blocking flap for pivoting about a substantially horizontal pivot axis to assume said closed position thereof when extending substantially vertically;

a bar rigid with said substantially plate-shaped blocking flap and extending transversely thereof; and said weight being supported on said bar for selective displacement on the same to different distances from said substantially plate-shaped blocking flap.

5. The arrangement as defined in claim 4, wherein:

said blocking flap extends upwardly from said substantially horizontal pivot axis; and said bar is arranged in the immediate vicinity of said substantially horizontal pivot axis and extends substantially normal to said substantially plate-shaped blocking flap towards said gas output chamber.

6. An arrangement for feeding fiber material, especially to a carding device, comprising:

a feed chute having a plurality of peripheral walls one of which is gas-permeable and together bounding an accumulation space having an open upper end for receiving the fiber material travelling through a transporting duct with a gaseous transportation medium and a lower end where the fiber material accumulates in the form of a fiber body upon deposition from the transportation medium that leaves said accumulation space through said gas-permeable wall;

a feeding roller pair arranged at said lower end of said accumulation space and operative for feeding the fiber material of said fiber body out of said accumulation space;

means for bounding a gas output chamber in juxtaposition with said gas-permeable wall of said feed chute, including a wall different from said gas-permeable wall and having a gas output opening;

gas discharge means communicating with said gas output opening;

means for controlling the flow of the transportation medium into and through said accumulation space, said gas output chamber, and said gas discharge means, including a blocking flap pivotably mounted at said different wall for movement between a closed position in which it blocks said gas output opening so that supply of the fiber material into said feed duct is stopped and a plurality of open positions in which it offers selected amounts of resistance to the flow of said transportation medium through said gas output opening; and means for adjusting the position of said blocking flap relative to said gas output opening in dependence on the quantity of the fiber material of said fiber body which passes between rollers of said feeding roller pair.

* * * * *